US012005306B2

(12) United States Patent
Hogan

(10) Patent No.: US 12,005,306 B2
(45) Date of Patent: Jun. 11, 2024

(54) SWING TRAINER BALANCE BLOCK APPARATUS

(71) Applicant: Brendan Hogan, Phoenix, AZ (US)

(72) Inventor: Brendan Hogan, Phoenix, AZ (US)

( * ) Notice: Subject to any disclaimer, the term of this patent is extended or adjusted under 35 U.S.C. 154(b) by 418 days.

(21) Appl. No.: 17/361,286

(22) Filed: Jun. 28, 2021

(65) Prior Publication Data

US 2022/0409951 A1 Dec. 29, 2022

(51) Int. Cl.

| | |
|---|---|
| ***A63B 22/16*** | (2006.01) |
| ***A63B 69/00*** | (2006.01) |
| ***A63B 69/36*** | (2006.01) |

(52) U.S. Cl.

CPC ..... *A63B 22/16* (2013.01); *A63B 69/0002* (2013.01); *A63B 69/3673* (2013.01); *A63B 2069/0008* (2013.01); *A63B 2208/0204* (2013.01); *A63B 2214/00* (2020.08)

(58) Field of Classification Search

CPC ..... A63B 22/16; A63B 22/18; A63B 69/0002; A63B 69/3673; A63B 69/003; A63B 2069/0008; A63B 2208/0204; A63B 2214/00; A63B 2022/185; A63B 2023/006

See application file for complete search history.

(56) References Cited

U.S. PATENT DOCUMENTS

| | | | | |
|---|---|---|---|---|
| 4,759,542 | A | 7/1988 | Hudec | |
| 5,897,474 | A | 4/1999 | Romero | |
| D663,001 | S | 7/2012 | Newell | |
| 8,517,853 | B2 * | 8/2013 | Miller | A63B 69/3673 473/270 |
| 8,678,985 | B2 | 3/2014 | Mattox | |
| 9,011,264 | B2 | 4/2015 | Tang | |
| 9,370,705 | B2 * | 6/2016 | Grzesiak | F16L 3/23 |
| D776,767 | S | 1/2017 | Randleman | |
| 9,533,191 | B2 | 1/2017 | Carbone | |
| 2004/0033864 | A1 * | 2/2004 | Elbaz | A63B 21/0004 482/148 |
| 2015/0321051 | A1 * | 11/2015 | Olson | A63B 26/003 482/139 |

FOREIGN PATENT DOCUMENTS

| | | |
|---|---|---|
| CA | 2596900 | 2/2008 |

* cited by examiner

*Primary Examiner* — Megan Anderson

(57) ABSTRACT

A swing trainer balance block apparatus for improving balance during swing training includes a foot board having a board top side, a board bottom side, a board front side, a board back side, a board left side, and a board right side. The board top side receives a portion of a user's foot. A base support is coupled to the foot board. The base support is coupled to the board bottom side and is elastically deformable to create instability in the foot board. One swing trainer balance block apparatus is used beneath each of the user's feet to stimulate stabilizer muscles while practicing swinging a baseball bat or a golf club.

9 Claims, 6 Drawing Sheets

SWING TRAINER BALANCE BLOCK APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to swing training devices and more particularly pertains to a new swing training device for improving balance during swing training. The present device includes a small rigid platform for each foot to balance on. Each platform has a flat, elastically deformable, support to cause instability during the user's swing training for a sport such as golf or baseball.

(2) Description of Related Art Including Information Disclosed Under 37 CFR 1.97 and 1.98

The prior art relates to swing training devices. Known devices typically employ a single platform to be stood on with both feet. A rounded support beneath the platform creates instability for the user to balance on. These devices lack smaller, independent platforms for each foot.

BRIEF SUMMARY OF THE INVENTION

An embodiment of the disclosure meets the needs presented above by generally comprising a foot board having a board top side, a board bottom side, a board front side, a board back side, a board left side, and a board right side. The board top side is configured to receive a portion of a user's foot. A base support is coupled to the foot board. The base support is coupled to the board bottom side and is elastically deformable to create instability in the foot board. One swing trainer balance block apparatus is used beneath each of the user's feet to stimulate stabilizer muscles while practicing swinging a baseball bat or a golf club.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
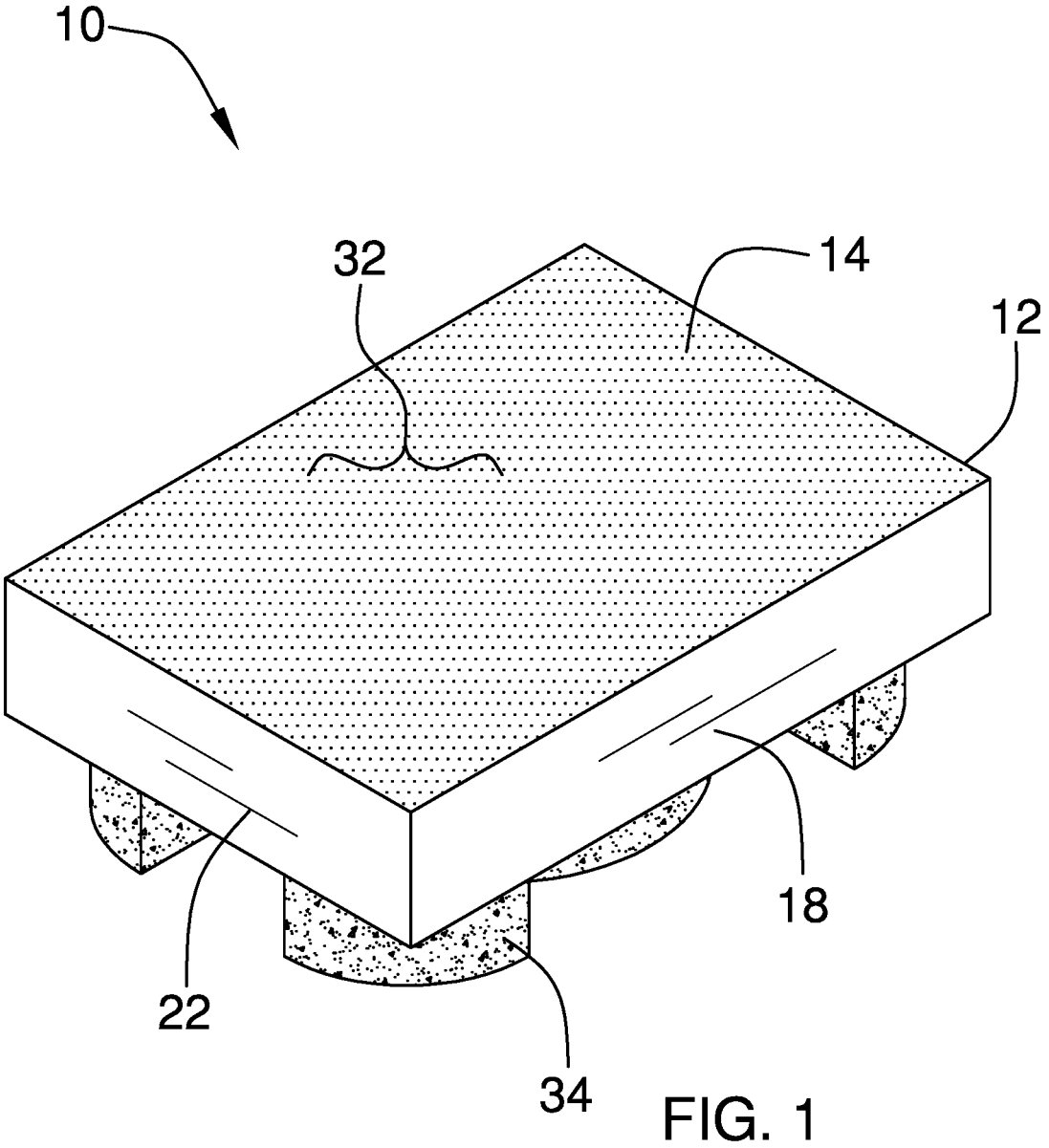
FIG. 1 is an isometric view of a swing trainer balance block apparatus according to an embodiment of the disclosure.
Figure 2:
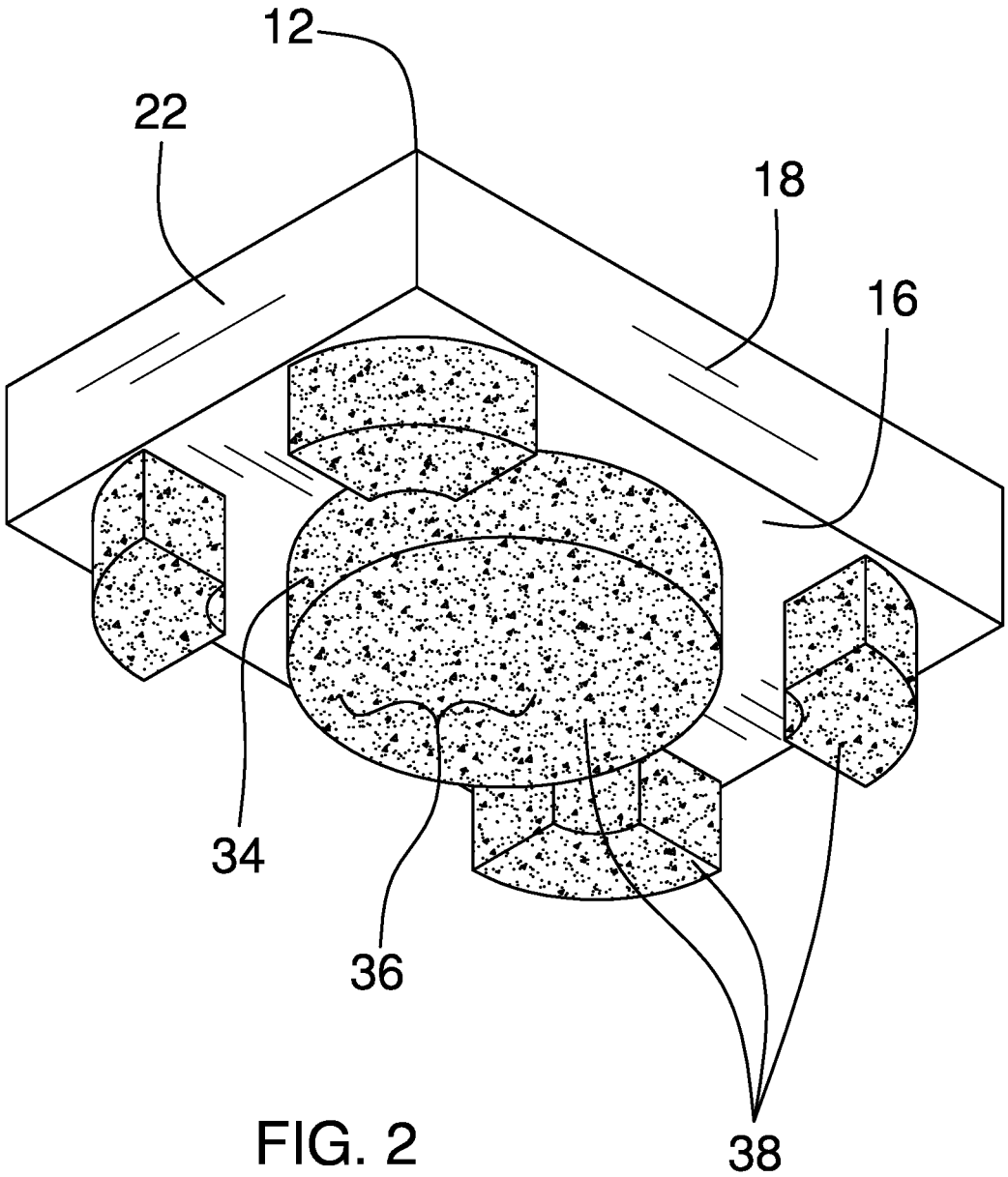
FIG. 2 is an isometric view of an embodiment of the disclosure.
Figure 3:
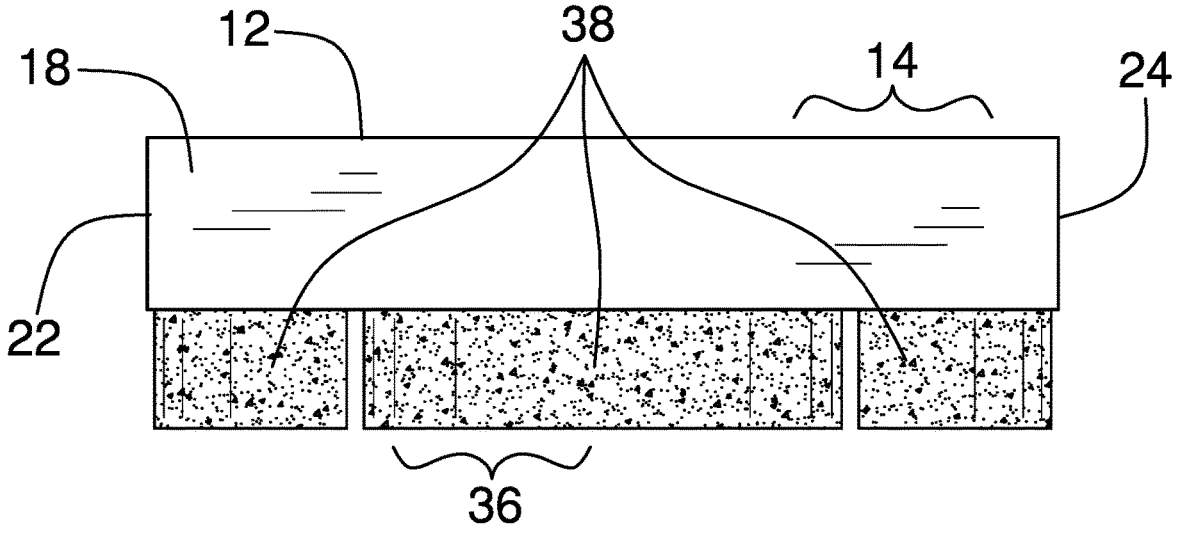
FIG. 3 is a side elevation view of an embodiment of the disclosure.
Figure 4:
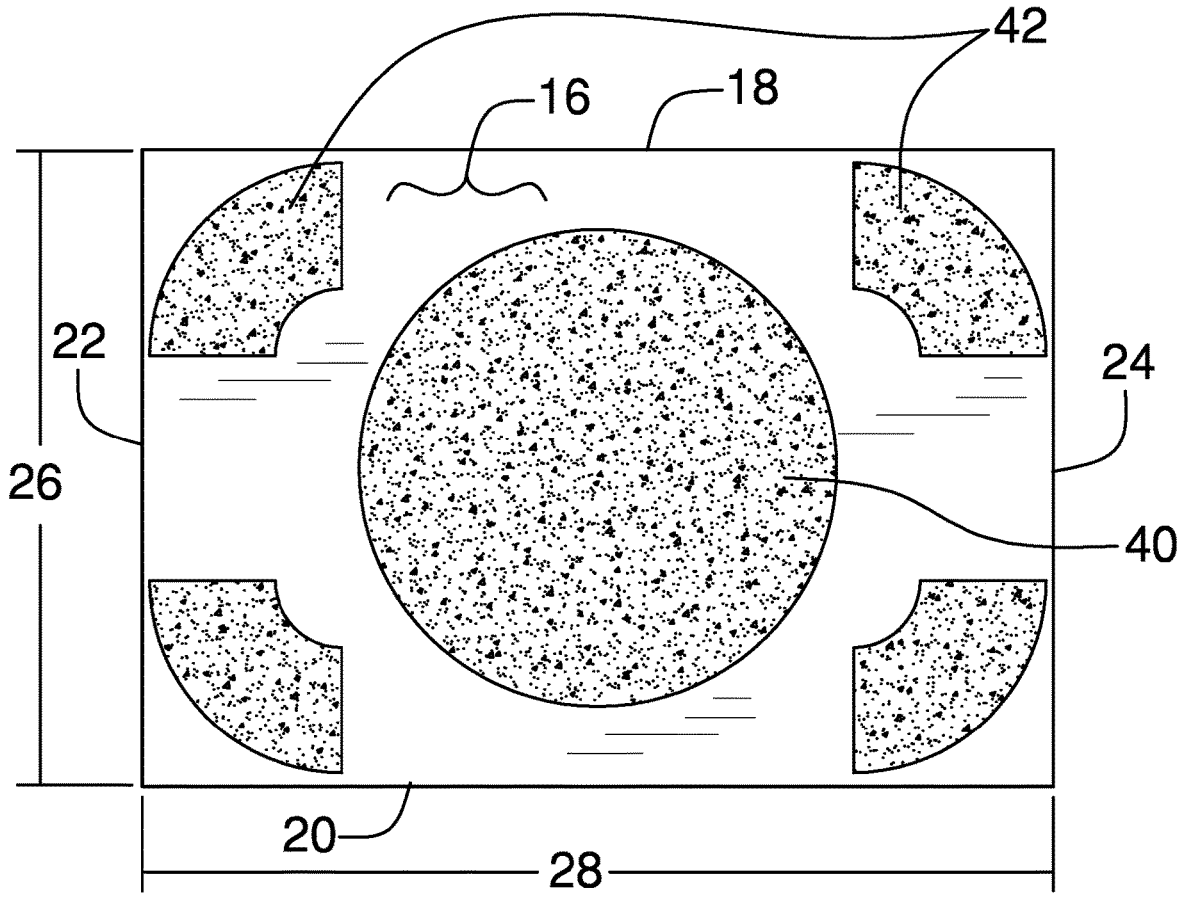
FIG. 4 is a bottom plan view of an embodiment of the disclosure.
Figure 5:
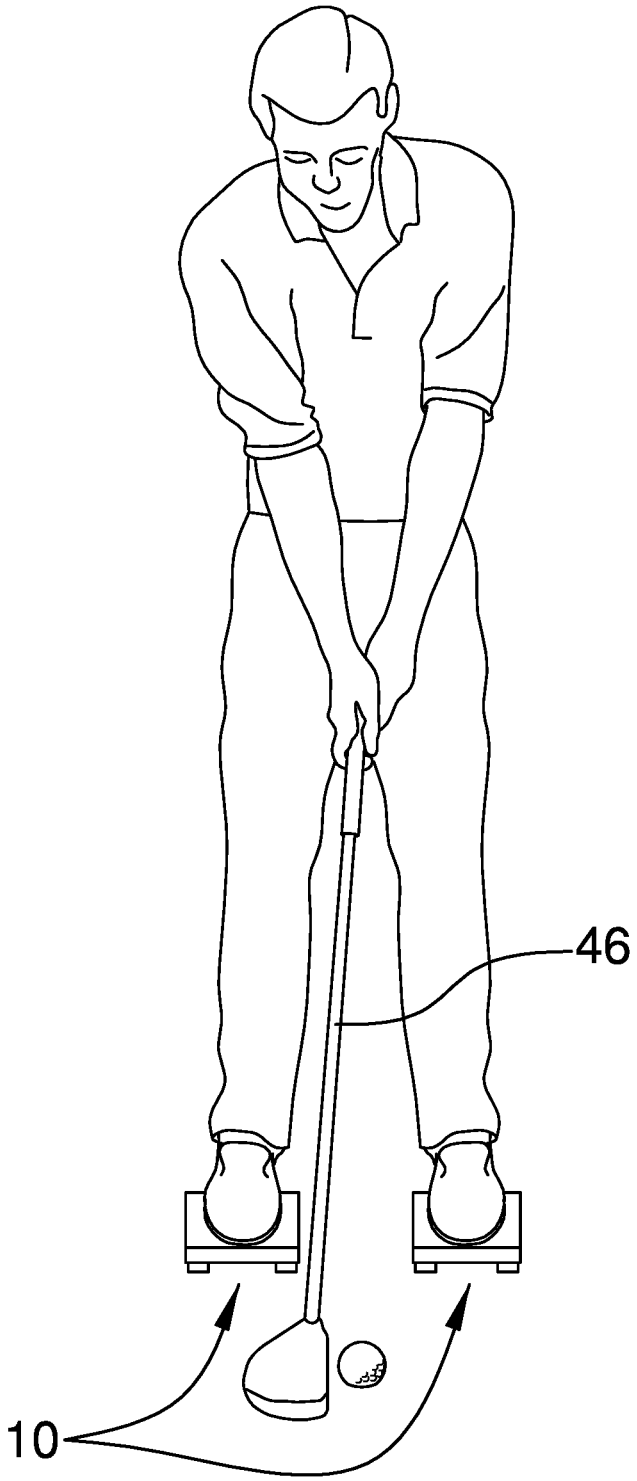
FIG. 5 is an in-use view of an embodiment of the disclosure.
Figure 6:
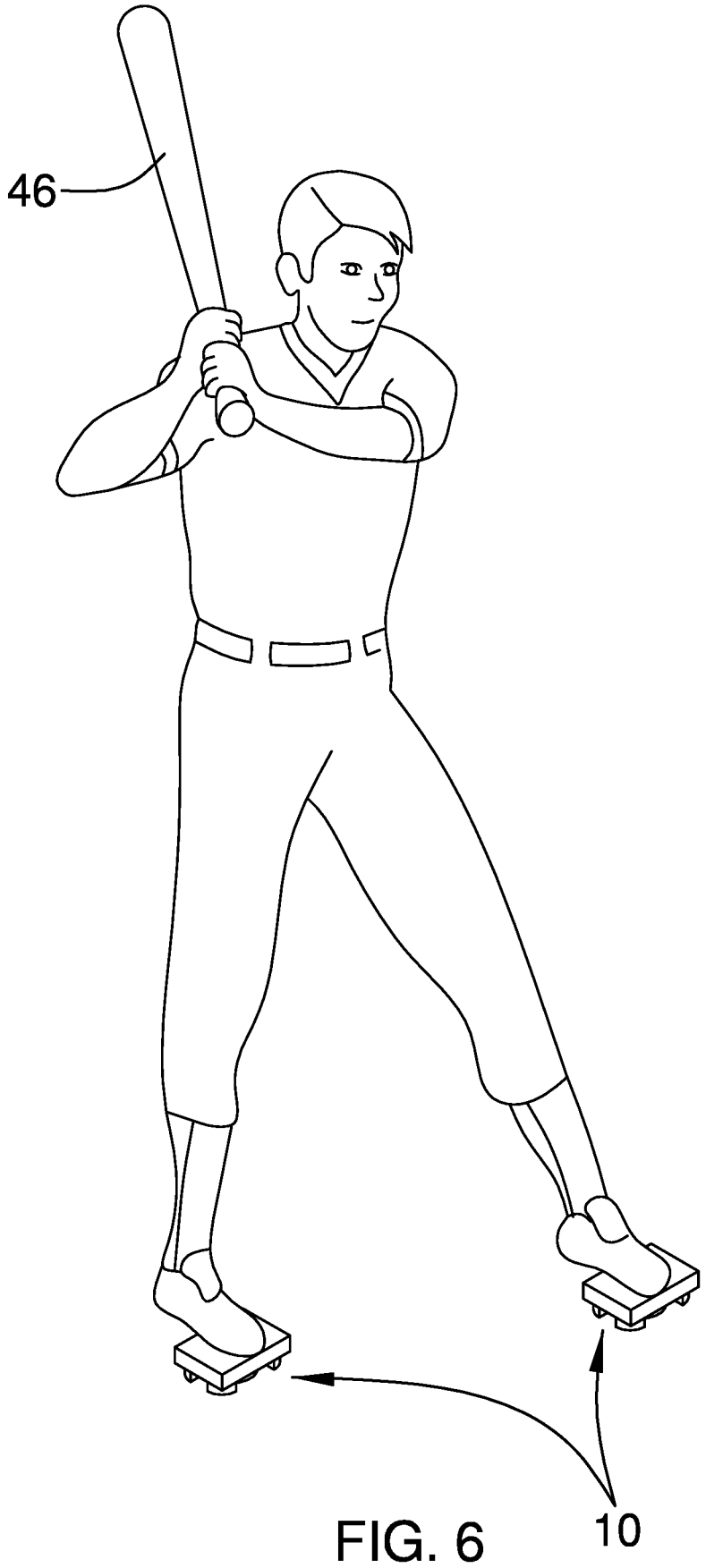
FIG. 6 is an in-use view of an embodiment of the disclosure.
Figure 7:
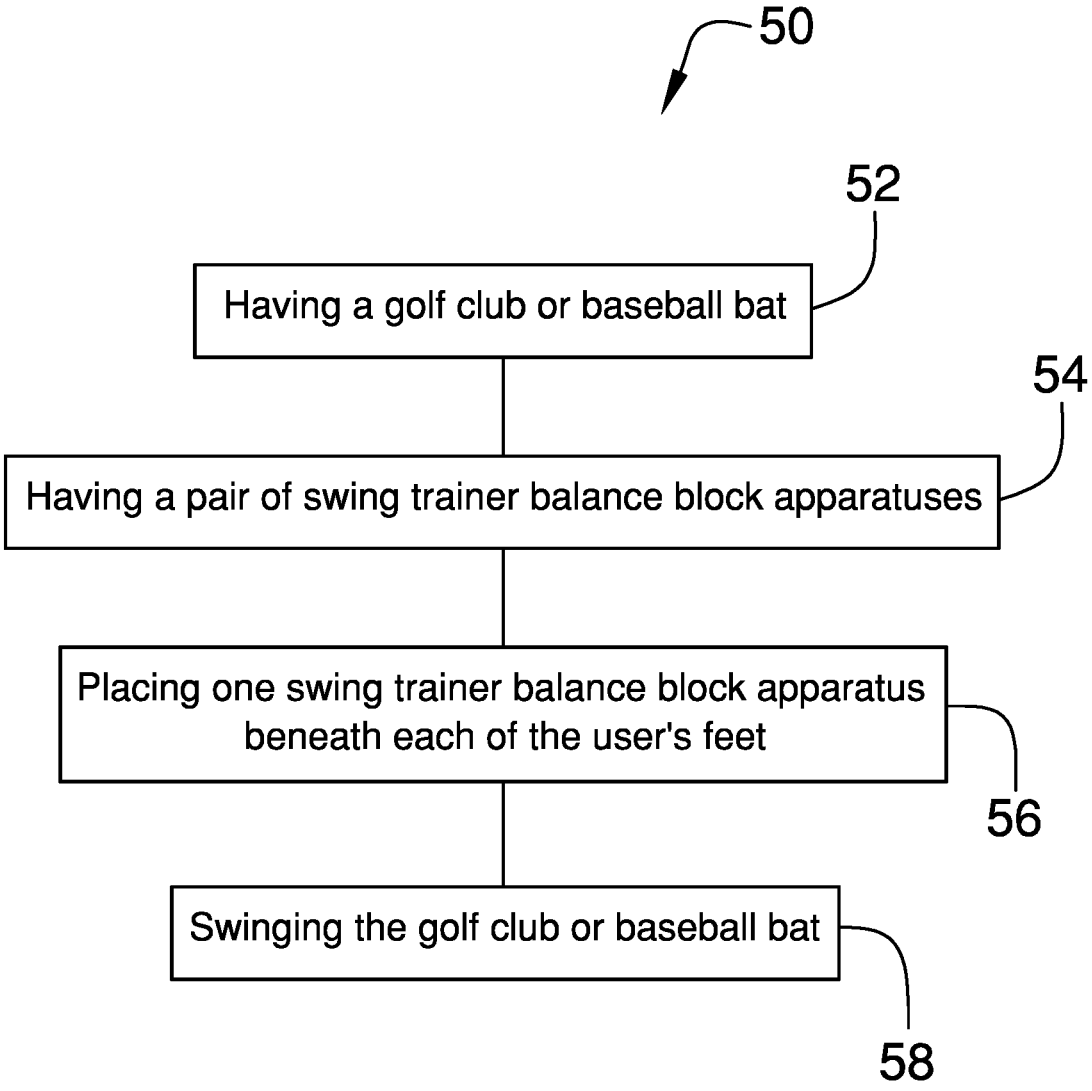
FIG. 7 is a flow chart view of an embodiment of the disclosure.

With reference now to the drawings, and in particular to FIGS. 1 through 7 thereof, a new swing training device embodying the principles and concepts of an embodiment of the disclosure and generally designated by the reference numeral 10 will be described.

As best illustrated in FIGS. 1 through 7, the swing trainer balance block apparatus 10 generally comprises a foot board 12 having a board top side 14, a board bottom side 16, a board front side 18, a board back side 20, a board left side 22, and a board right side 24. The foot board 12 may be rectangular prismatic. A board depth 26 between the board front side 18 and the board back side 20 may be less than a board width 28 between the board left side 22 and the board right side 24. The board top side 14 is configured to receive a portion of a user's foot 30. The user may position the foot 30 across the board depth 26 so as to hang their heel or toes off of the foot board 12.

A grip layer 32 may be coupled to the foot board 12. The grip layer 32 is coupled to the board top side 14 and may be continuously coupled on the board top side 14. The grip layer 32 prevents slippage for the user's foot 30. The grip layer 32 may be textured or semi-adhesive to increase friction.

A base support 34 is coupled to the foot board 12. The base support 34 is coupled to the board bottom side 14. The base support 34 may have a planar support bottom surface 36. The base support 34 is elastically deformable to create instability in the foot board 12 when pressure is applied by the user's foot 30. The base support 34 may comprise a plurality of support blocks 38 each coupled to the board bottom side 16. The plurality of support blocks 38 may include a central block 40 and a plurality of peripheral bocks 42. The central block 40 may be circular and centrally located on the board bottom side 14 and each peripheral block 42 may be arcuate and positioned close to the corners of the board bottom side 14. One swing trainer balance block apparatus 12 is used beneath each of the user's feet 30 to stimulate stabilizer muscles while practicing swinging a baseball bat 44 or a golf club 46. Each support block 38 may thus independently deform when the user's weight shifts during the swinging motion to engage the user's stabilizer muscles.

In use, the swing trainer balance block apparatus 10 allows for a method of swing training comprising 50 comprising a step 52 comprising having the golf club 46 or baseball bat 44. A step 54 comprises having a pair of swing trainer balance block apparatuses 10. A step 56 comprises placing one swing trainer balance block apparatus 10 beneath each of the user's feet 30. A step 58 comprises swinging the golf club 46 or baseball bat 44.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A swing trainer balance block apparatus comprising:

a foot board having a board top side, a board bottom side, a board front side, a board back side, a board left side, and a board right side, the board top side being configured to receive a portion of a user's foot; and a base support coupled to the foot board, the base support being coupled to the board bottom side, the base support being elastically deformable to create instability in the foot board, the base support having a planar support bottom surface;

wherein one of the swing trainer balance block apparatus is used beneath each of the user's feet to stimulate stabilizer muscles while practicing swinging a baseball bat or a golf club.

2. The swing trainer balance block apparatus of claim 1 further comprising the base support comprising a plurality of support blocks each coupled to the board bottom side.

3. The swing trainer balance block apparatus of claim 2 wherein the plurality of support blocks including comprises a central block and a plurality of peripheral bucks.

4. The swing trainer balance block apparatus of claim 3 further comprising the central block being circular and each peripheral block of the plurality of peripheral blocks being arcuate.

5. The swing trainer balance block apparatus of claim 1 further comprising a grip layer coupled to the foot board, the grip layer being coupled to the board top side.

6. The swing trainer balance block apparatus of claim 5 further comprising the grip layer being continuously coupled on the board top side.

7. The swing trainer balance block apparatus of claim 1 further comprising the foot board being rectangular prismatic, a board depth between the board front side and the board back side being less than a board width between the board left side and the board right side.

8. A swing trainer balance block apparatus comprising:

a foot board having a board top side, a board bottom side, a board front side, a board back side, a board left side, and a board right side, the foot board being rectangular prismatic, a board depth between the board front side and the board back side being less than a board width between the board left side and the board right side, the board top side being configured to receive a portion of a user's foot;

a grip layer coupled to the foot board, the grip layer being coupled to the board top side, the grip layer being continuously coupled on the board top side; and a base support coupled to the foot board, the base support being coupled to the board bottom side, the base support having a planar support bottom surface, the base support being elastically deformable to create instability in the foot board, the base support comprising a plurality of support blocks each coupled to the board bottom side, the plurality of support blocks including a central block and a plurality of peripheral hocks, the central block being circular and each peripheral block of the plurality of peripheral blocks being arcuate;

wherein one of the swing trainer balance block apparatus is used beneath each of the user's feet to stimulate stabilizer muscles while practicing swinging a baseball bat or a golf club.

9. A method of swing training comprising:

having a golf club or baseball bat;

having a pair of swing trainer balance block apparatuses, each comprising:

a foot board having a board top side, a board bottom side, a board front side, a board back side, a board left side, and a board right side, the foot board being rectangular prismatic, a board depth between the board front side and the board back side being less than a board width between the board left side and the board right side, the board top side being configured to receive a portion of a user's foot;

a grip layer coupled to the foot board, the grip layer being coupled to the board top side, the grip layer being continuously coupled on the board top side; and a base support coupled to the foot board, the base support being coupled to the board bottom side, the base support having a planar support bottom surface, the base support being elastically deformable to create instability in the foot board, the base support comprising a plurality of support blocks each coupled to the board bottom side, the plurality of support blocks including a central block and a plurality of peripheral blocks, the central block being circular and each peripheral block of the plurality of peripheral blocks being arcuate;

placing one of the pair of swing trainer balance block apparatus beneath each of the user's feet; and and swinging the golf club or baseball bat.

* * * * *